US010979833B2

(12) United States Patent
Miyamoto et al.

(10) Patent No.: US 10,979,833 B2
(45) Date of Patent: Apr. 13, 2021

(54) ACOUSTICAL PERFORMANCE EVALUATION METHOD

(71) Applicant: Panasonic Intellectual Property Management Co., Ltd., Osaka (JP)

(72) Inventors: Yasunori Miyamoto, Kanagawa (JP); Keisuke Fujimoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/701,344

(22) Filed: Dec. 3, 2019

(65) Prior Publication Data

US 2020/0107144 A1 Apr. 2, 2020

Related U.S. Application Data

(63) Continuation of application No. PCT/JP2018/021357, filed on Jun. 4, 2018.

(30) Foreign Application Priority Data

Jun. 5, 2017 (JP) ..... JP2017-110591

(51) Int. Cl.
*H04R 29/00* (2006.01)
*H04R 5/04* (2006.01)

(52) U.S. Cl.
CPC ..... *H04R 29/001* (2013.01); *H04R 29/004* (2013.01); *H04R 5/04* (2013.01)

(58) Field of Classification Search
CPC ..... H04R 29/001; H04R 29/004; H04R 5/04
See application file for complete search history.

(56) References Cited

U.S. PATENT DOCUMENTS

2008/0037805 A1 2/2008 Kino et al.
2015/0271603 A1 9/2015 Goto et al.

FOREIGN PATENT DOCUMENTS

JP 2007-288468 11/2007
JP 2015-179118 10/2015

OTHER PUBLICATIONS

International Search Report dated Sep. 4, 2018 in International (PCT) Application No. PCT/JP2018/021357.

*Primary Examiner* — Regina N Holder
(74) *Attorney, Agent, or Firm* — Wenderoth, Lind & Ponack, L.L.P.

(57) ABSTRACT

An acoustical performance evaluation method includes a reference sound pressure decision step and a deviation calculation step. In the reference sound pressure decision step, frequency response of sound pressure level, obtained by considering only an influence of a first factor of a plurality of factors causing a deterioration in frequency response of sound pressure level of a loudspeaker to be evaluated, are decided as a reference sound pressure. The reference sound pressure is frequency response of sound pressure level of the loudspeaker in the anechoic chamber calculated through a simulation or measured through a measurement experiment. In the deviation calculation step, a deviation between the reference sound pressure and a target sound pressure is calculated as an evaluation index of acoustical performance. The target sound pressure is frequency response of sound pressure level of the loudspeaker in the anechoic chamber calculated through a simulation or measured through a measurement experiment.

14 Claims, 16 Drawing Sheets

DIFFERENTIAL AREA CORRESPONDING TO EVALUATION INDEX WITHOUT SOUND LEAKAGE

DIFFERENTIAL AREA CORRESPONDING TO TOTAL EVALUATION INDEX

FIG. 14

| CONFIGURATION | | | dB/Oct | $dB^2$/Oct | f1 | f2 |
|---|---|---|---|---|---|---|
| 1 | LOUDSPEAKER | IDEAL HOUSING (219) | - | - | 20Hz | 500Hz |
| 2 | LOUDSPEAKER | HOUSING (212) | 3.0dB | $9.5dB^2$ | 20Hz | 500Hz |
| 3 | LOUDSPEAKER | HOUSING (213) | 2.5dB | $6.3dB^2$ | 20Hz | 500Hz |

ACOUSTICAL PERFORMANCE EVALUATION METHOD

BACKGROUND

1. Technical Field

The present disclosure relates to an acoustical performance evaluation method.

2. Description of the Related Art

It is known that acoustical performance of a loudspeaker as an object are evaluated or set by using flat frequency performance as a target (for example, PTL (Patent Literature) 1).

The acoustical performance of the loudspeaker as the object are generally evaluated by using the frequency performance of the loudspeaker stored in a box (hereinafter, referred to as a JIS box) decided according to Japanese Industrial Standards (JIS).

Here, PTL 1 is Unexamined Japanese Patent Publication No. 2015-179118A.

SUMMARY

However, when a loudspeaker to be evaluated is stored in a non-box-shaped housing such as a television or a vehicle of which a shape is decided in advance, the flat frequency performance or the frequency performance of the JIS box cannot be achieved even though any countermeasure is prepared for the non-box-shaped housing. That is, there is a problem that the frequency performance of the loudspeaker to be evaluated cannot be accurately evaluated even though the frequency performance of the loudspeaker to be evaluated are compared with the flat frequency performance or the frequency performance of the JIS box as a reference.

The present disclosure has been made in view of the aforementioned circumstances, and provides an acoustical performance evaluation method capable of accurately evaluating acoustical performance of a loudspeaker to be evaluated.

An acoustical performance evaluation method according to an aspect of the present disclosure includes a reference sound pressure decision step and a deviation calculation step. In the reference sound pressure decision step, frequency response of sound pressure level, obtained by considering only an influence of a first factor of a plurality of factors causing a deterioration in frequency response of sound pressure level of a loudspeaker to be evaluated, are decided as a reference sound pressure. The reference sound pressure is frequency response of sound pressure level of the loudspeaker in the anechoic chamber calculated through a simulation or is measured through a measurement experiment. In the deviation calculation step, a deviation between the reference sound pressure and a target sound pressure is calculated as an evaluation index of acoustical performance. The target sound pressure is frequency response of sound pressure level of the loudspeaker in the anechoic chamber calculated through a simulation or measured through a measurement experiment.

These comprehensive or specific aspects may be achieved by a system, a method, an integrated circuit, a computer program, or a recording medium such as a computer-readable CD-ROM, and may be achieved by any combination of the system, the method, the integrated circuit, the computer program, and the recording medium.

The acoustical performance evaluation method of the present disclosure can accurately evaluate the acoustical performance of the loudspeaker to be evaluated.

BRIEF DESCRIPTION OF DRAWINGS

FIG. 14 is a diagram illustrating an example of an evaluation index of estimated acoustical performance.

DETAILED DESCRIPTION

Hereinafter, an exemplary embodiment of a display device according to the present disclosure will be described with reference to the drawings.

The following exemplary embodiment is merely an example of the display device according to the present disclosure. Therefore, the scope of the present disclosure is defined by the wording of the claims with reference to the following exemplary embodiment, and is not limited to the following exemplary embodiment. Thus, components that are not described in the independent claims indicating the highest concept of the present disclosure among components of the following exemplary embodiment are not necessary to achieve the object of the present disclosure, but are described as components of a more preferable mode.

The drawings are schematic diagrams in which emphasis, omissions, and ratio adjustment are appropriately performed in order to illustrate the present disclosure, and may differ from actual shape, positional relationship, and ratios.

Exemplary Embodiment

[Configuration of Acoustical Performance Evaluation System]

Figure 1:
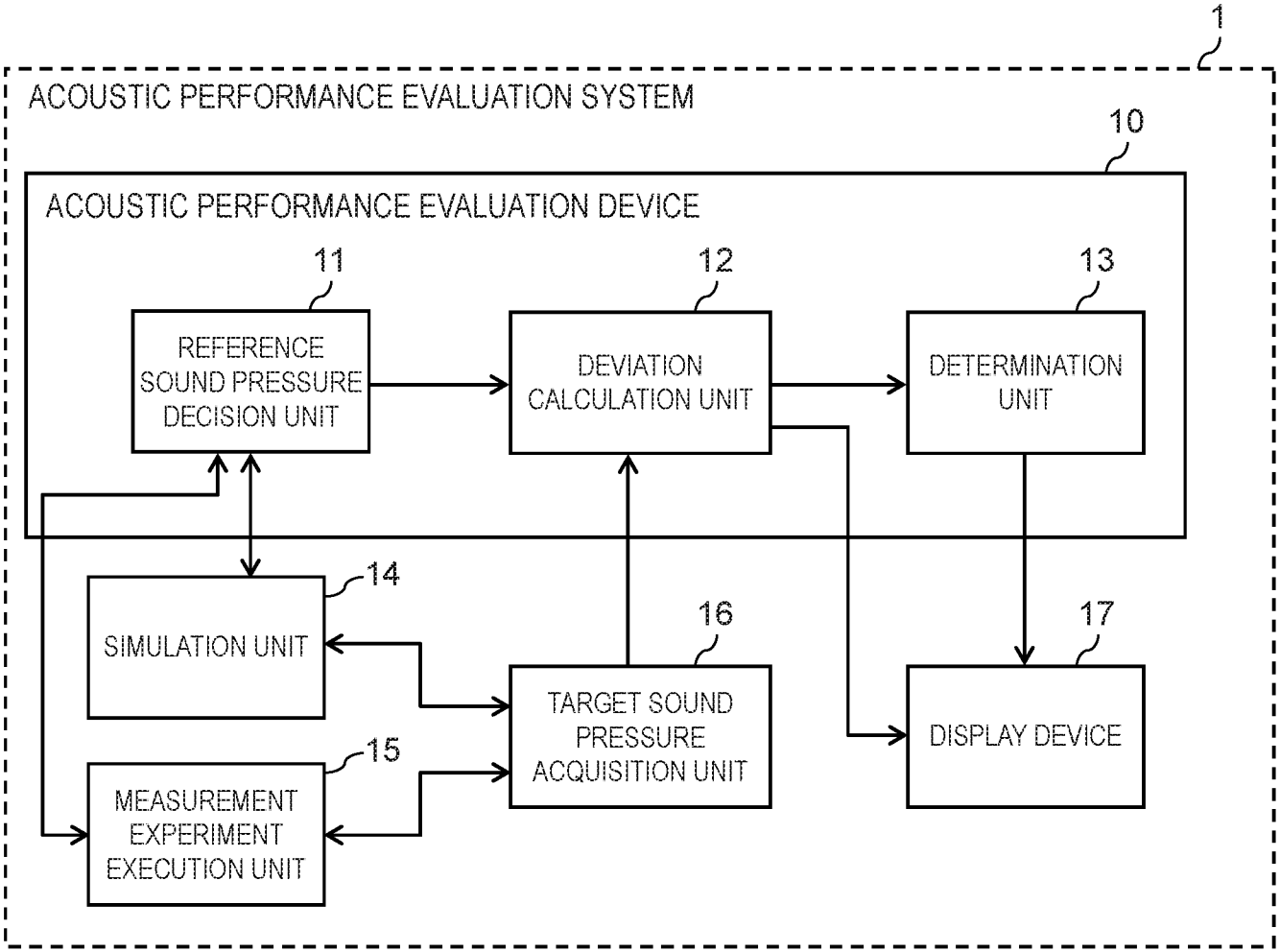
FIG. 1 is a diagram illustrating an example of a configuration of an acoustical performance evaluation system of an exemplary embodiment.
Figure 2:
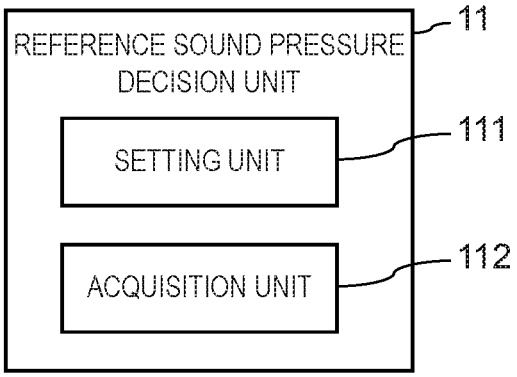
FIG. 2 is diagram illustrating an example of a detailed configuration of a reference sound pressure decision unit illustrated in FIG. 1.

FIG. 1 is a diagram illustrating an example of a configuration of an acoustical performance evaluation system according to the exemplary embodiment. FIG. 2 is a diagram illustrating an example of the detailed configuration of a reference sound pressure decision unit illustrated in FIG. 1.

Acoustical performance evaluation system 1 illustrated in FIG. 1 includes acoustical performance evaluation device 10, simulation unit 14, measurement experiment execution unit 15, target sound pressure acquisition unit 16, and display device 17. Acoustical performance evaluation system 1 is used for evaluating acoustical performance of a loudspeaker to be evaluated, and is implemented by a computer including a central processing unit (CPU) and a memory.

[Acoustical Performance Evaluation Device 10]

Acoustical performance evaluation device 10 quantifies an evaluation index for evaluating the acoustical performance of the loudspeaker to be evaluated. For example, acoustical performance evaluation device 10 includes reference sound pressure decision unit 11, deviation calculation unit 12, and determination unit 13, as illustrated in FIG. 1.

<Reference Sound Pressure Decision Unit 11>

Reference sound pressure decision unit 11 decides, as a reference sound pressure, frequency response of sound pressure level of the loudspeaker in an anechoic chamber measured through a measurement experiment or frequency response of sound pressure level calculated through a simulation with consideration for an influence of a first factor. Here, the first factor is one of a plurality of factors that causes a deterioration in frequency response of sound pressure level of the loudspeaker to be evaluated, and is a factor which is not caused in the loudspeaker itself. For example, the first factor is a shape of an object in which the loudspeaker is attached. The plurality of factors includes, for example, a shape of the object, an internal space of the object, a vibration of the object, and a sound leakage from the object.

In the present exemplary embodiment, reference sound pressure decision unit 11 includes, for example, setting unit 111 and acquisition unit 112, as illustrated in FIG. 2.

<<Setting Unit 111>>

Setting unit 111 sets an ideal state of frequency performance of the loudspeaker as the reference sound pressure. More specifically, setting unit 111 sets, as the reference sound pressure, frequency response of sound pressure level with consideration for only the influence of the first factor for which a countermeasure for enhancing the frequency response of sound pressure level of the loudspeaker is not preparable among the plurality of factors that causes the deterioration in frequency response of sound pressure level of the loudspeaker.

When the loudspeaker is stored in a non-box-shaped housing in which a shape of the loudspeaker is decided in advance, the first factor is a shape of the non-box-shaped housing. For example, when the loudspeaker is embedded in a television, the first factor is a shape of a housing of the television. When the loudspeaker is embedded in a side door of a vehicle, the first factor is a shape of the side door. When the loudspeaker is embedded in a telephone such as a mobile phone, the first factor is a shape of a housing of the telephone.

A first ideal state which is flat frequency response of sound pressure level, a second ideal state which is frequency response of sound pressure level in a JIS box, a third ideal state which is frequency response of sound pressure level in the anechoic chamber, and a fourth ideal state which is frequency response of sound pressure level with consideration for only the influence of the first factor are considered as the ideal state of the frequency performance of the loudspeaker. However, when the loudspeaker is stored in the non-box-shaped housing of which the shape is decided in advance such as the television or the vehicle as stated above, the first ideal state and the second ideal state cannot be achieved even though any countermeasure is prepared for the non-box-shaped housing. The third ideal state merely indicates an ideal state of the housing in design, and cannot be used for determining how to prepare a sound leakage countermeasure and stiffness enhancement for the non-box-shaped housing. Thus, in the present exemplary embodiment, the fourth ideal state is considered as a realistic ideal state, and is used as the reference sound pressure. That is, when the loudspeaker is provided in the non-box-shaped housing, an ideal state in which ideal performance including the non-box-shaped housing are assumed is used as the reference sound pressure.

In the present exemplary embodiment, the plurality of factors includes the shape of the object, the internal space of the object, the vibration of the object, and the sound leakage from the object, as described above. When the loudspeaker is embedded in, for example, a door of the vehicle, the plurality of factors includes a shape of the door, an internal space of the door, a vibration of the door, and a sound leakage from the door. Here, the internal space corresponds to a parameter indicating an air quantity within the object. The vibration corresponds to a parameter indicating a stiffness of the object. The sound leakage corresponds to a parameter indicating combinability of a member constituting the object, that is, a design concept of the member. When the object is the door of the vehicle, the sound leakage can occur by a gap such as a hole for a switch of the door such as a door lock or a ratchet or a mounting hole of a handle for opening and closing. A countermeasure can be prepared for the sound leakage in door design. Meanwhile, the shape of the door is caused by the design of the vehicle such as a shape of a door frame of the side door of the vehicle, and it is difficult to prepare a countermeasure for the shape of the door by simply changing the shape of the door frame itself. Thus, when the loudspeaker is embedded in or attached to the non-box-shaped object, it is preferable that the frequency response of sound pressure level including the deterioration in frequency response of sound pressure level caused by the shape (first factor) of the object can be evaluated. The evaluation of the frequency response of sound pressure level is useful for achieving a design in which the deterioration in frequency response of sound pressure level including other factors is suppressed as a whole.

Setting unit 111 selects a method of setting the frequency response of sound pressure level of the reference sound pressure by setting performed by an input of a user of acoustical performance evaluation system 1 or setting performed in advance. The setting method includes a method of setting the frequency response of sound pressure level of the reference sound pressure measured through the measurement experiment and a method of setting the frequency response of sound pressure level of the reference sound pressure calculated through a numeric calculation simulation.

Setting unit 111 sets a threshold for determining whether or not a target sound pressure is favorable by comparing the threshold with an evaluation index value to be described below. Setting unit 111 sets, as the threshold, a value input by the user of acoustical performance evaluation system 1 or a value input in advance.

<<Acquisition Unit 112>>

Acquisition unit 112 acquires the frequency response of sound pressure level of the reference sound pressure according to the setting method selected by setting unit 111. More specifically, acquisition unit 112 acquires the frequency response of sound pressure level of the loudspeaker in the anechoic chamber which are the frequency response of sound pressure level with consideration for only the influence of the first factor from simulation unit 14 or measurement experiment execution unit 15 according to the setting method selected by setting unit 111. The frequency response of sound pressure level acquired by acquisition unit 112 are set (decided) as the reference sound pressure by setting unit 111.

<Deviation Calculation Unit 12>

Deviation calculation unit 12 calculates, as an evaluation index (evaluation quantity) of the acoustical performance, a deviation between the target sound pressure and the reference sound pressure. Here, the target sound pressure is frequency response of sound pressure level of the loudspeaker in the anechoic chamber calculated through the simulation or measured through the measurement experiment. More specifically, deviation calculation unit 12 calculates the deviation between the target sound pressure and the reference sound pressure by multiplying a ratio between first function data indicating the reference sound pressure and second function data indicating the target sound pressure by a predetermined weight function in a frequency domain and integrating the multiplied value. Here, the target sound pressure is calculated through the simulation or is measured through the measurement experiment with consideration for two or more factors including the first factor of the plurality of factors described above.

For example, the deviation may be a differential area integral average of a graph indicated by the first function data indicating the reference sound pressure using a frequency as an argument and a sound pressure as a return value and a graph indicated by the second function data indicating the target sound pressure using the frequency as the argument and the sound pressure as the return value. In this case, when the deviation is dB/Oct, f1 is a lower limit frequency, f2 is an upper limit frequency, P1(f) is a first function of the first function data, and P2(f) is a second function of the second function data, the deviation can be calculated according to (Expression 1).

$$\mathrm{dB}/Oct = \frac{1}{\log_e(f2)-\log_e(f1)}\int_{f1}^{f2}\frac{|20\log_{10}(P_1(f)/P_2(f))|}{f}df \quad \text{(Expression 1)}$$

That is, a differential pressure between the target sound pressure and the reference sound pressure can be calculated by dB conversion by using (Expression 1). An average value can be calculated as the deviation by multiplying the ratio between the first function data and the second function data by a weight function of 1/f in a predetermined frequency interval indicated by a range from f1 to f2 to be evaluated, integrating the multiplied value, and dividing the integrated value by a horizontal axis length ($\log_e f2-\log_e f1$) of an octave scale using f1 as a base.

Hereinafter, the deviation indicated by dB/Oct is referred to as a deviation in a differential pressure magnification dB notation, but the deviation may not be the differential area integral average or the deviation in the differential pressure magnification dB notation. For example, the deviation may be a standard deviation between the first function data indicating the reference sound pressure using the frequency as the argument and the sound pressure as the return value and the second function data indicating the target sound pressure using the frequency as the argument and the sound pressure as the return value. In this case, when the deviation is $dB^2$/Oct, f1 is the lower limit frequency, f2 is the upper limit frequency, P1(f) is the first function of the first function data, and P2(f) is the second function of the second function data, the deviation can be calculated according to (Expression 2).

$$\mathrm{dB}^2/Oct = \frac{1}{\log_e(f2)-\log_e(f1)}\int_{f1}^{f2}\frac{|20\log_{10}(P_1(f)/P_2(f))|^2}{f}df \quad \text{(Expression 2)}$$

That is, a differential pressure deviation quantity of square of the differential pressure between the target sound pressure and the reference sound pressure can be calculated by $dB^2$ conversion by using (Expression 2). An average value can be calculated as the deviation by multiplying the ratio between the first function data and the second function data by a weight function of 1/f in a predetermined frequency interval indicated by a range from f1 to f2 to be evaluated, integrating the multiplied value, and dividing the integrated value by a horizontal axis length ($\log_e f2-\log_e f1$) of an octave scale using f1 as a base. Hereinafter, the deviation indicated by $dB^2$/Oct is referred to as a deviation in a differential pressure magnification square dB notation.

Since both dB and Oct are dimensionless quantities and do not have physical dimensions, dB/Oct and $dB^2$/Oct which are evaluation indices may have any unit system. For example, when the acoustical performance are evaluated by an expression obtained by further multiplying a right side of (Expression 1) or (Expression 2) by a constant term, the evaluation index has a unit of the constant term, and when the evaluation index has the dimensionless quantity as it is, the evaluation index may not have a unit, and references may be unified.

In the present exemplary embodiment, deviation calculation unit 12 calculates, as the evaluation index (evaluation quantity) of the acoustical performance, the deviation between the target sound pressure acquired by target sound pressure acquisition unit 16 and the reference sound pressure decided by reference sound pressure decision unit 11.

Figure 3:
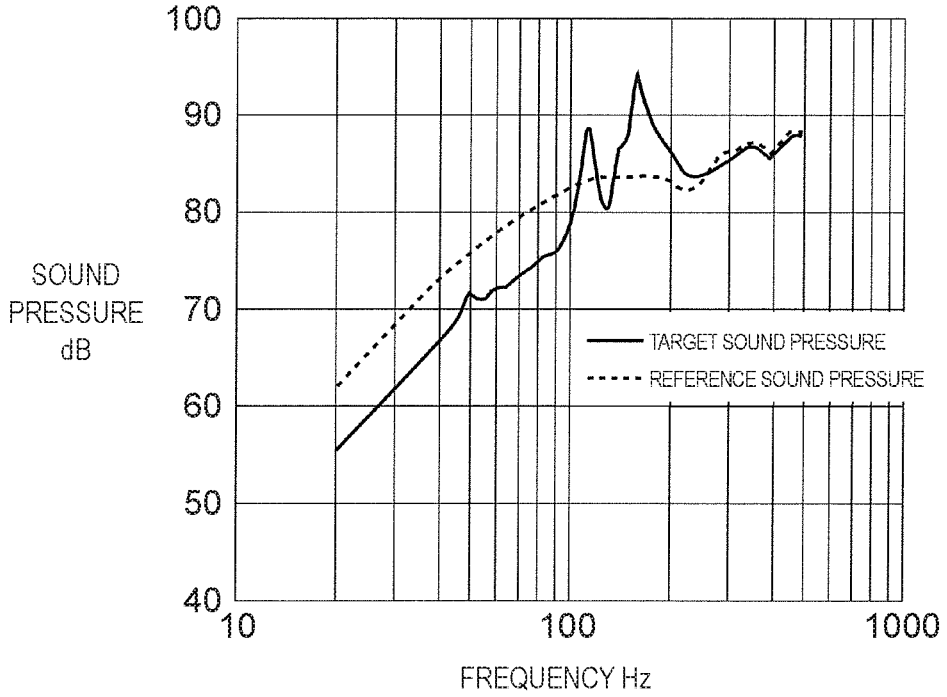
FIG. 3 is a diagram illustrating examples of a target sound pressure and a reference sound pressure of the exemplary embodiment.
Figure 4:
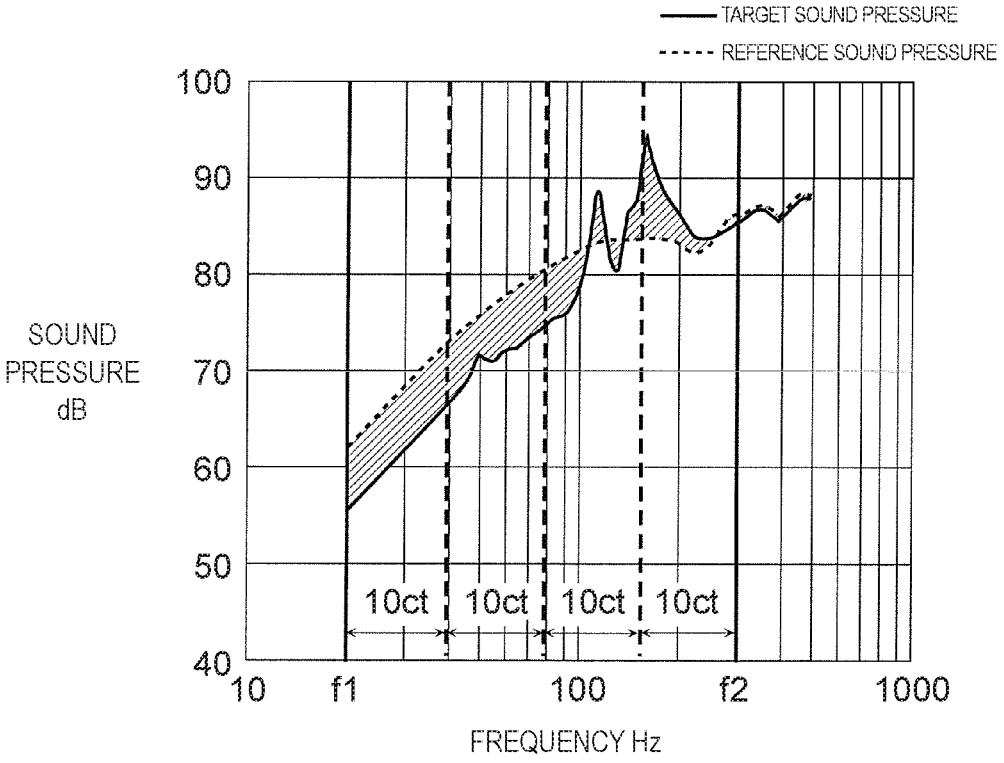
FIG. 4 is a diagram illustrating an example of an evaluation index of acoustical performance of the target sound pressure of the exemplary embodiment.

FIG. 3 is a diagram illustrating examples of the target sound pressure and the reference sound pressure of the exemplary embodiment. FIG. 4 is a diagram illustrating examples of the evaluation index of the acoustical performance of the target sound pressure of the exemplary embodiment.

For example, deviation calculation unit 12 calculates the deviation by using the target sound pressure and the reference sound pressure as illustrated in FIG. 3. As stated above, the reference sound pressure illustrated in FIG. 3 is the frequency response of sound pressure level calculated through the simulation with consideration for only the influence of the first factor for which the countermeasure for enhancing the frequency response of sound pressure level is not prep arable among the plurality of factors that causes the deterioration in frequency response of sound pressure level of the loudspeaker. The target sound pressure illustrated in FIG. 3 is the frequency response of sound pressure level calculated through the simulation with consideration for two or more factors including the first factor of the plurality of factors.

For example, deviation calculation unit 12 may calculate, as the deviation, that is, the evaluation index of the acoustical performance, the differential area integral average represented by a hatched portion in FIG. 4, and may calculate, as the evaluation index of the acoustical performance, the differential area integral average in the set frequency interval. Deviation calculation unit 12 may calculate, as the evaluation index (evaluation quantity) of the acoustical performance, the deviation in the differential pressure magnification dB notation or the deviation in the differential pressure magnification square dB notation by using a differential pressure of a region represented by the hatched portion.

<Determination Unit 13>

Determination unit 13 determines whether or not the target sound pressure is favorable by using the evaluation index (evaluation quantity) calculated by deviation calculation unit 12, and outputs the determination result to, for example, display device 17.

More specifically, determination unit 13 compares the threshold acquired by reference sound pressure decision unit 11 with the evaluation index (evaluation quantity) calculated by deviation calculation unit 12. For example, when the evaluation index is smaller than the threshold, since the target sound pressure approaches the reference sound pressure which is the realistic ideal state, determination unit 13 determines that the target sound pressure is favorable.

[Simulation Unit 14]

Simulation unit 14 is a computer including a CPU and a memory, and simulation program software is introduced. Simulation unit 14 can perform the numeric calculation simulation on the frequency response of sound pressure level of the loudspeaker in the anechoic chamber by executing the simulation program software.

In the present exemplary embodiment, when reference sound pressure decision unit 11 selects the method of setting the reference sound pressure through the numeric calculation simulation, simulation unit 14 performs the numeric calculation simulation on the frequency response of sound pressure level with consideration for only the influence of the first factor which is the frequency response of sound pressure level of the loudspeaker in the anechoic chamber. Simulation unit 14 outputs the simulated result to reference sound pressure decision unit 11.

When target sound pressure acquisition unit 16 selects the method of setting the target sound pressure through the numeric calculation simulation, simulation unit 14 performs the numeric calculation simulation on the frequency response of sound pressure level with consideration for two or more factors including the first factor of the plurality of factors which is the frequency response of sound pressure level of the loudspeaker in the anechoic chamber. Simulation unit 14 outputs the simulation result to target sound pressure acquisition unit 16.

[Measurement Experiment Execution Unit 15]

Measurement experiment execution unit 15 is a computer including a CPU and a memory, and program software for performing the measurement experiment is introduced. Measurement experiment execution unit 15 can measure the frequency response of sound pressure level of the loudspeaker by executing the measurement experiment program software.

In the present exemplary embodiment, when reference sound pressure decision unit 11 selects the method of setting the reference sound pressure through the measurement experiment, measurement experiment execution unit 15 acquires the frequency response of sound pressure level with consideration for only the influence of the first factor which is the frequency response of sound pressure level of the loudspeaker in the anechoic chamber through the measurement experiment. Measurement experiment execution unit 15 outputs the acquired frequency response of sound pressure level to reference sound pressure decision unit 11.

When target sound pressure acquisition unit 16 selects the method of setting the target sound pressure through the measurement experiment, measurement experiment execution unit 15 acquires the frequency response of sound pressure level with consideration for two or more factors including the first factor of the plurality of factors which is the frequency response of sound pressure level of the loudspeaker in the anechoic chamber through the measurement experiment. Measurement experiment execution unit 15 outputs the acquired frequency response of sound pressure level to target sound pressure acquisition unit 16.

The measurement experiment program software may not be introduced as measurement experiment execution unit 15, or the frequency response of sound pressure level of the loudspeaker in the anechoic chamber which are the result measured through the experiment may be acquired as the execution result of the measurement experiment.

[Target Sound Pressure Acquisition Unit 16]

Target sound pressure acquisition unit 16 acquires the target sound pressure which is the frequency response of sound pressure level calculated through the simulation or the frequency response of sound pressure level of the loudspeaker in the anechoic chamber measured through the measurement experiment. Here, the target sound pressure is calculated through the simulation or is measured through the measurement experiment with consideration for two or more factors including the first factor of the plurality of factors, as described above.

In the present exemplary embodiment, target sound pressure acquisition unit 16 selects a method of acquiring the frequency response of sound pressure level of the target sound pressure by setting performed by the input of the user of acoustical performance evaluation system 1 or setting performed in advance. The acquiring method includes a method of acquiring the frequency response of sound pressure level of the target sound pressure measured through the measurement experiment and a method of acquiring the frequency response of sound pressure level of the target sound pressure calculated through the numeric calculation simulation.

Target sound pressure acquisition unit 16 acquires the frequency response of sound pressure level of the target sound pressure which are the frequency response of sound pressure level of the loudspeaker to be evaluated in an anechoic chamber according to the selected acquiring method.

[Display Device 17]

Display device 17 is, for example, a display. Display device 17 may be a liquid crystal display, may be a plasma display, or may be a cathode-ray tube (CRT).

In the present exemplary embodiment, display device 17 displays the determination result of whether or not the target sound pressure output from acoustical performance evaluation device 10 is favorable or the graphs of the reference sound pressure and the target sound pressure acquired by acoustical performance evaluation device 10. Display device 17 may display a differential area between the reference sound pressure and the target sound pressure in addition to the graphs of the reference sound pressure and the target sound pressure acquired by acoustical performance evaluation device 10.

[Operation of Acoustical Performance Evaluation Device 10 and Others]

<Operation of Acoustical Performance Evaluation Device 10>

Next, an operation of acoustical performance evaluation 10 described above will be described.

Figure 5:
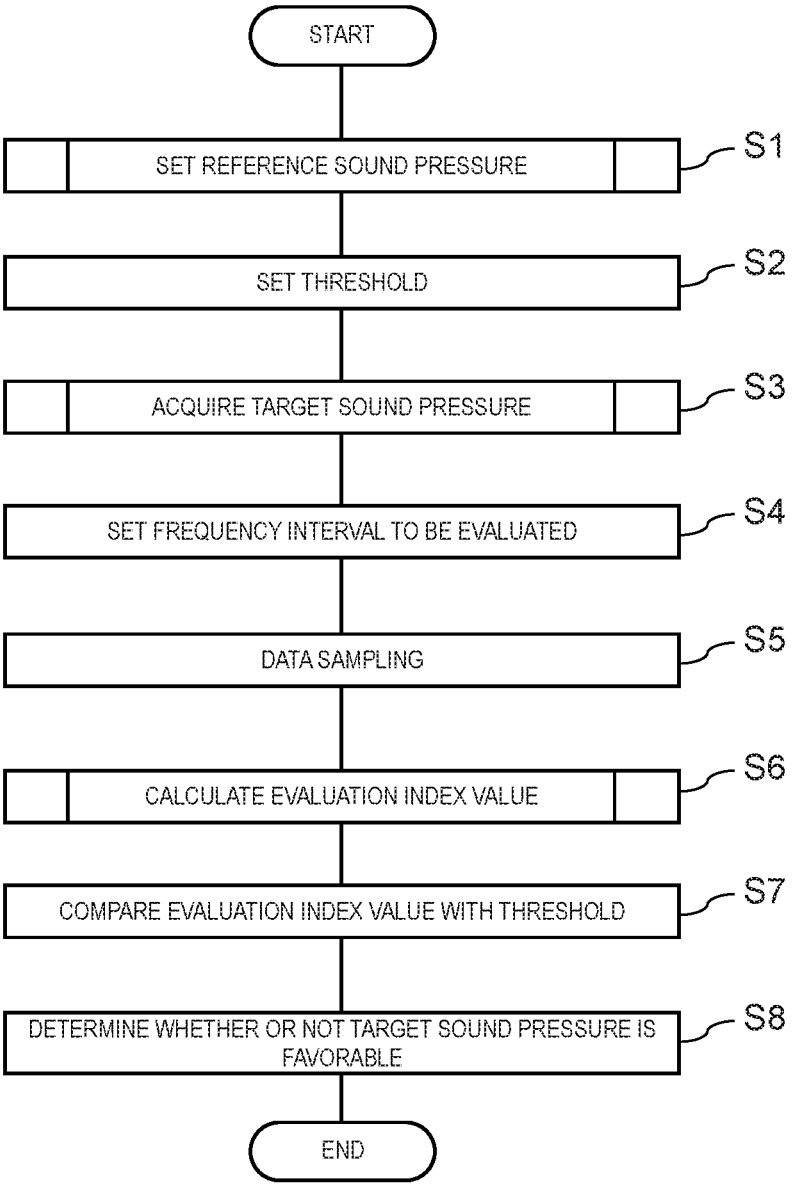
FIG. 5 is a flowchart for describing an acoustical performance evaluation method of an acoustical performance evaluation device of the exemplary embodiment.
Figure 6:
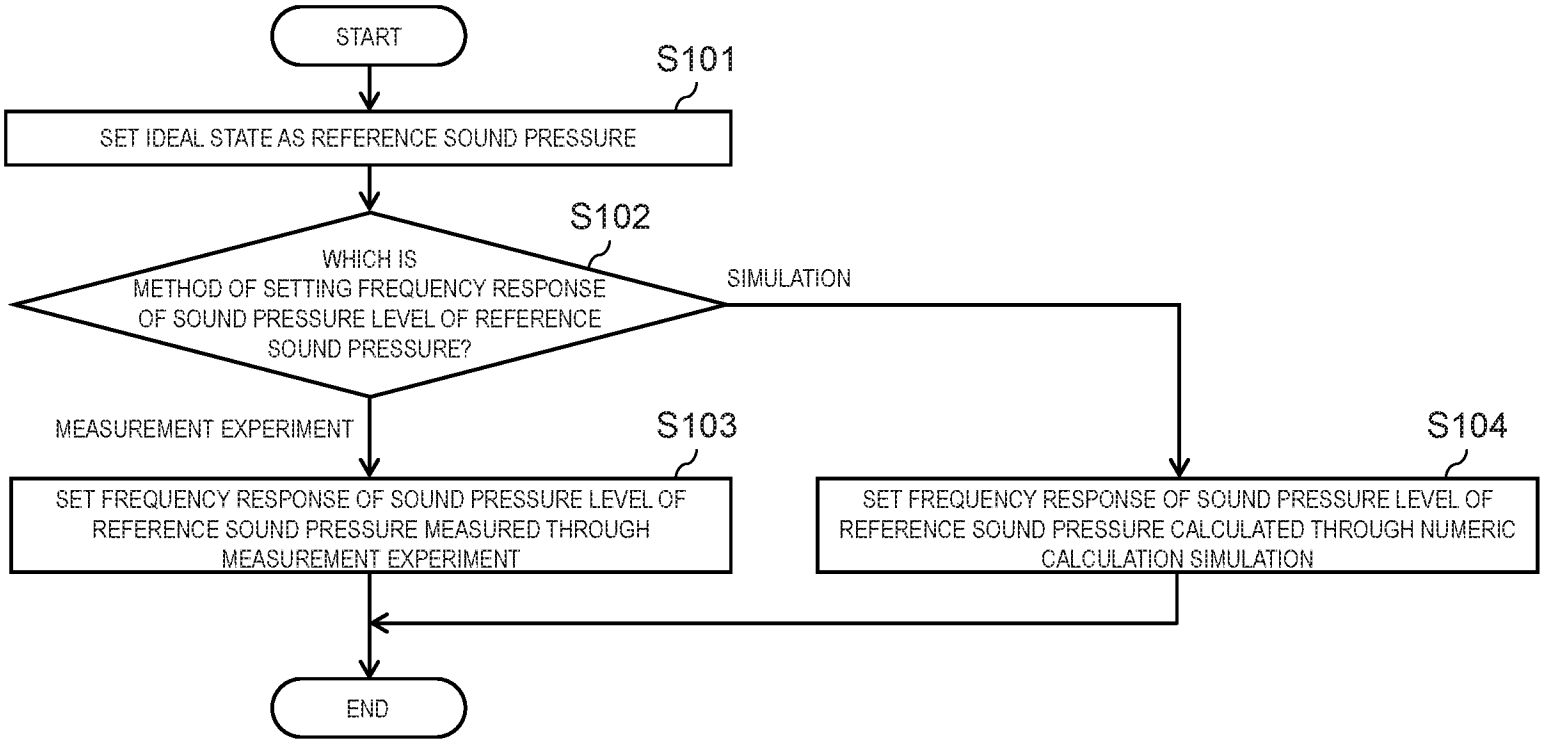
FIG. 6 is a flowchart illustrating a detailed process of step S1 illustrated in FIG. 5.
Figure 7:
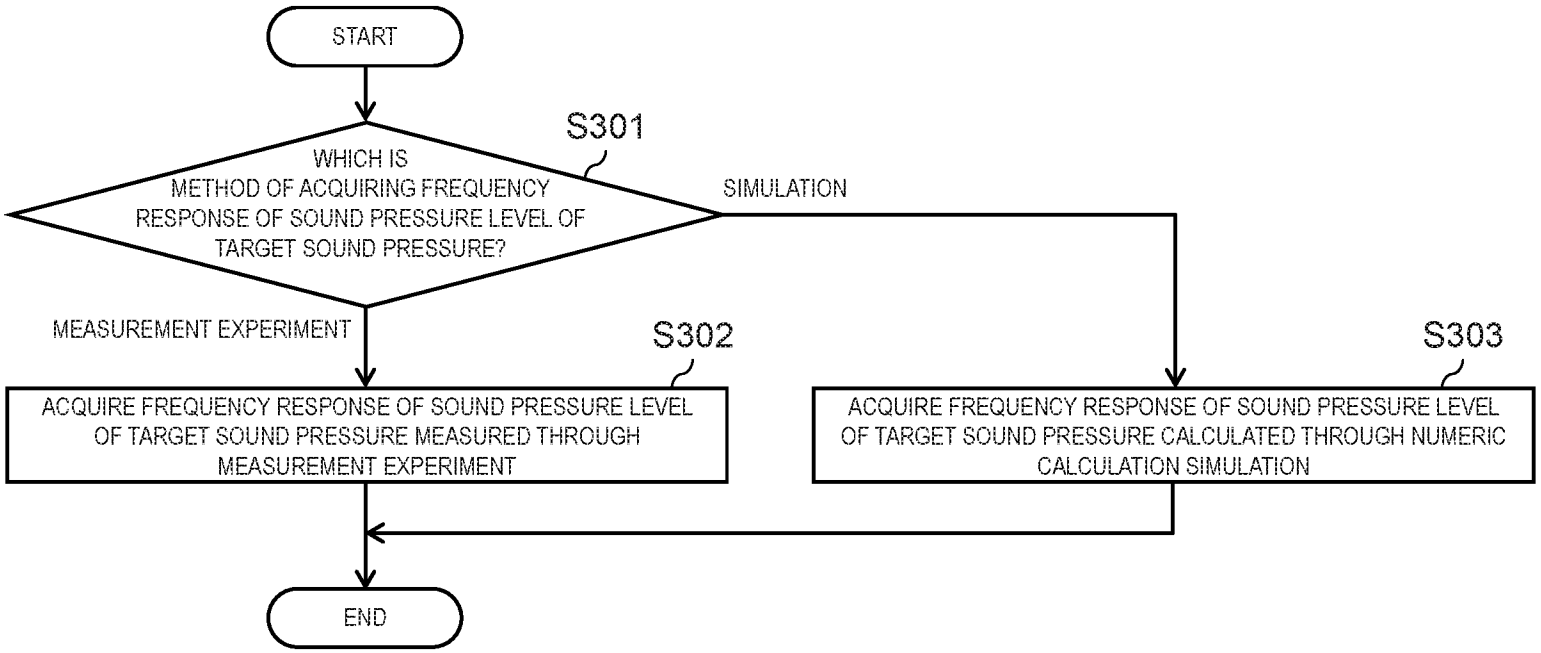
FIG. 7 is a flowchart illustrating a detailed process of step S3 illustrated in FIG. 5.
Figure 8A:
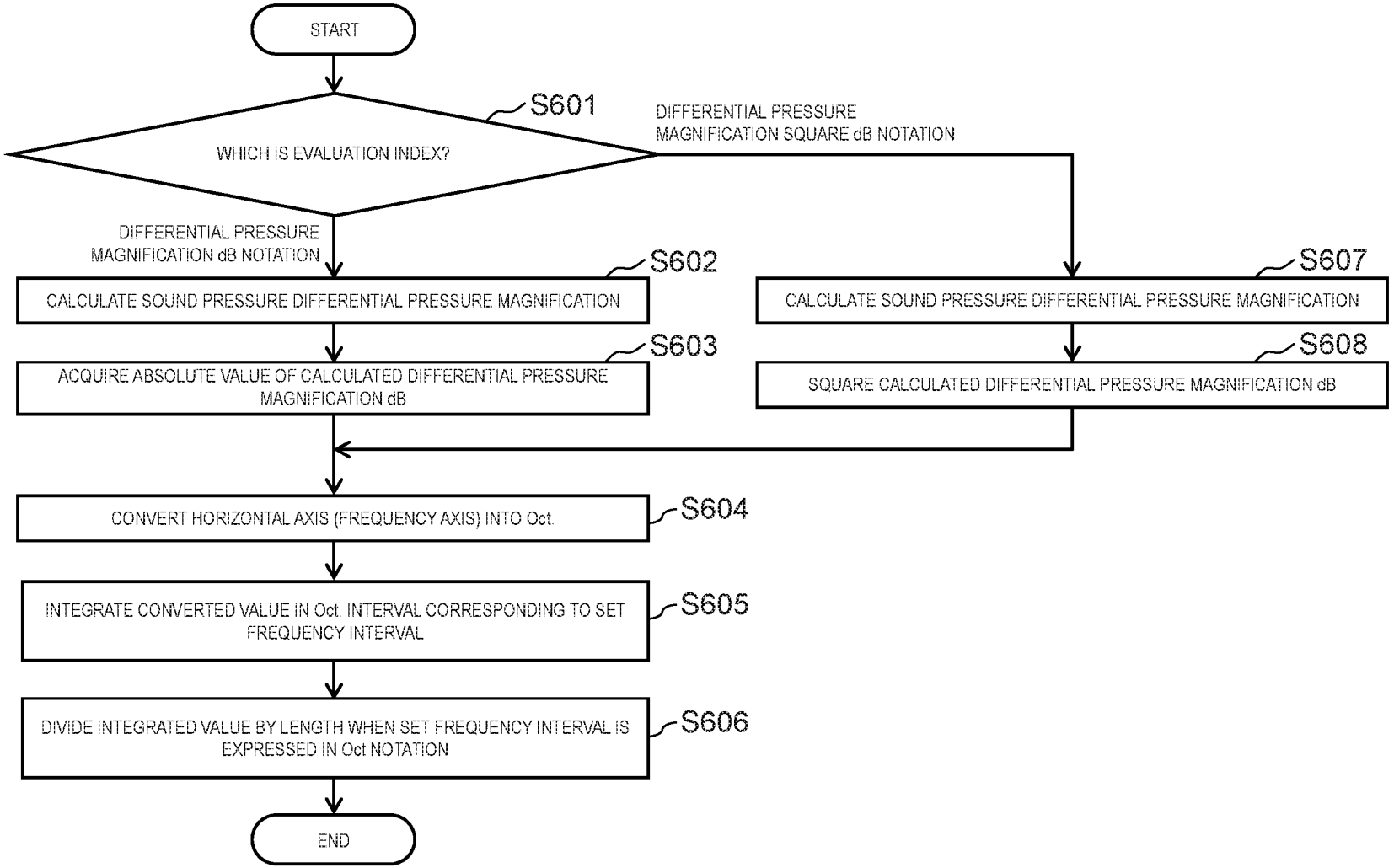
FIG. 8A is a diagram illustrating an example of a flowchart illustrating a detailed process of step S6 illustrated in FIG. 5.
Figure 8B:
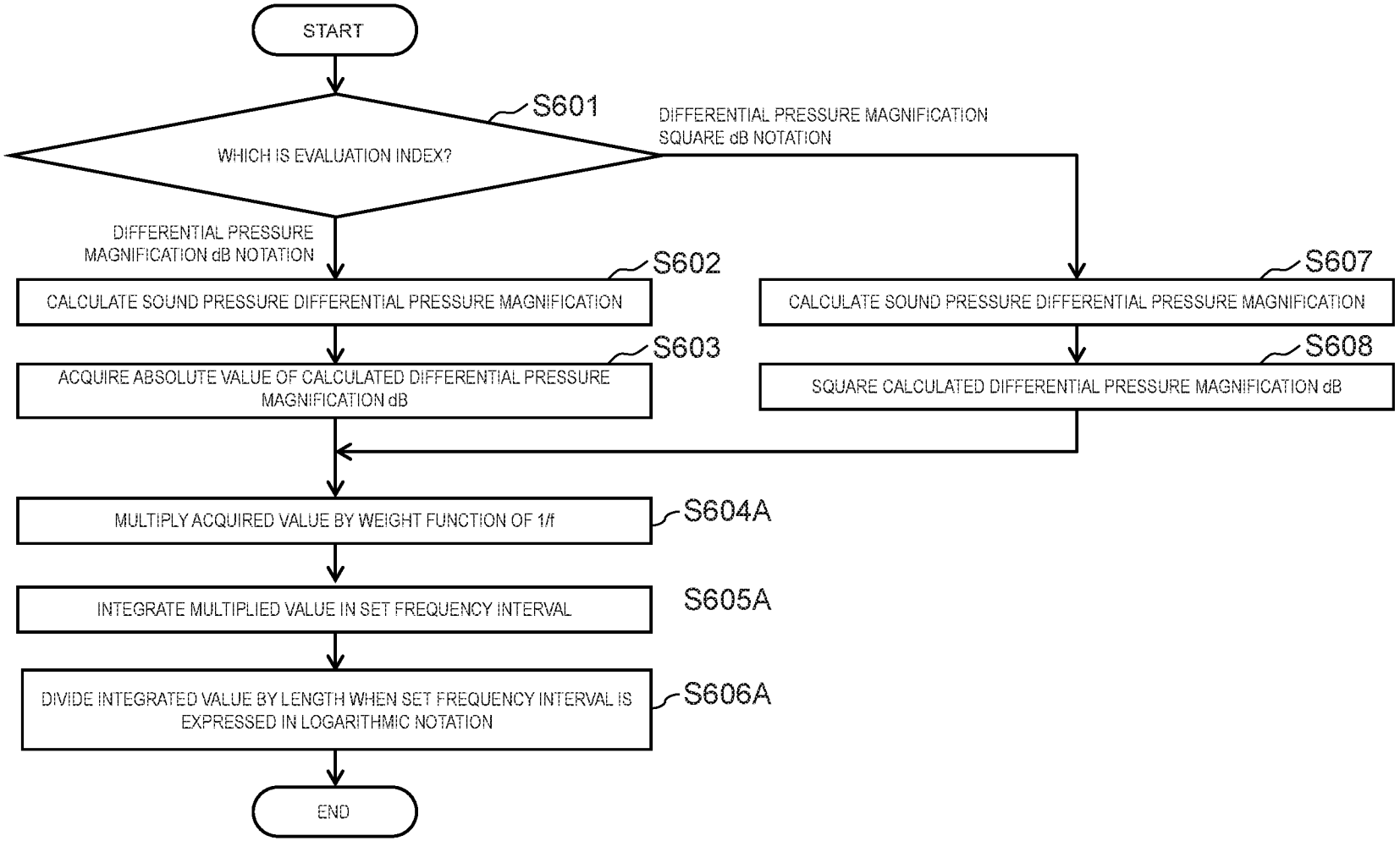
FIG. 8B is a diagram illustrating an example of a flowchart illustrating the detailed process of step S6 illustrating in FIG. 5.

FIG. 5 is a flowchart for describing an acoustical performance evaluation method of acoustical performance evaluation device 10 of the exemplary embodiment. FIG. 6 is a flowchart illustrating a detailed process of step S1 illustrated in FIG. 5. FIG. 7 is a flowchart illustrating a detailed process of step S3 illustrated in FIG. 5. FIGS. 8A and 8B are examples of flowcharts illustrating a detailed process of step S6 illustrated in FIG. 5.

As illustrated in FIG. 5, acoustical performance evaluation device 10 initially performs a reference sound decision process of setting the reference sound pressure (step S1). In the present exemplary embodiment, acoustical performance evaluation device 10 performs a process of deciding, as the reference sound pressure, the frequency response of sound pressure level of the loudspeaker in the anechoic chamber calculated through the simulation or measured through the measurement experiment which are the frequency response of sound pressure level with consideration for only the influence of the first factor of the plurality of factors that causes the deterioration in frequency response of sound pressure level of the loudspeaker to be evaluated.

More specifically, as illustrated in FIG. 6, acoustical performance evaluation device 10 initially sets the ideal state of the frequency performance of the loudspeaker as the reference sound pressure (step S101). More specifically, acoustical performance evaluation device 10 sets, as the reference sound pressure, the frequency response of sound pressure level with consideration for only the influence of the first factor for which the countermeasure for enhancing the frequency response of sound pressure level of the loudspeaker is not preparable among the plurality of factors that causes the deterioration in frequency response of sound pressure level of the loudspeaker. Subsequently, acoustical performance evaluation device 10 selects the method of setting the frequency response of sound pressure level of the reference sound pressure (step S102). When the method of setting the reference sound pressure through the measurement experiment is selected in step S102 (measurement experiment in step S102), acoustical performance evaluation device 10 sets the frequency response of sound pressure level of the loudspeaker in the anechoic chamber measured through the measurement experiment with consideration for only the influence of the first factor (step S103). Meanwhile, when the method of setting the reference sound pressure through the simulation is selected in step S102 (simulation in step S102), acoustical performance evaluation device 10 sets the frequency response of sound pressure level of the loudspeaker in the anechoic chamber calculated through the numeric calculation simulation with consideration for only the influence of the first factor (step S104).

Subsequently, acoustical performance evaluation device 10 sets the threshold (step S2). In the present exemplary embodiment, acoustical performance evaluation device 10 sets the threshold for determining whether or not the target sound pressure is favorable by comparing the threshold with the evaluation index value according to an input performed by the user of acoustical performance evaluation system 1 or an input performed in advance.

Subsequently, acoustical performance evaluation device 10 performs a process of acquiring the target sound pressure (step S3). In the present exemplary embodiment, acoustical performance evaluation device 10 acquires the target sound pressure which is the frequency response of sound pressure level calculated through the simulation or the frequency response of sound pressure level of the loudspeaker in the anechoic chamber measured through the measurement experiment.

More specifically, as illustrated in FIG. 7, acoustical performance evaluation device 10 selects the method of acquiring the frequency response of sound pressure level of the target sound pressure (step S301). When the method of acquiring the target sound pressure through the measurement experiment is selected in step S301 (measurement experiment in step S301), acoustical performance evaluation device 10 acquires the frequency response of sound pressure level of the loudspeaker in the anechoic chamber measured through the measurement experiment with consideration for two or more factors including the first factor of the plurality of factors (step S302). Meanwhile, when the method of acquiring the target sound pressure through the simulation is selected in step S301 (simulation in step S301), acoustical performance evaluation device 10 acquires the frequency response of sound pressure level of the loudspeaker in the anechoic chamber calculated through the numeric calculation simulation with consideration for two or more factors including the first factor of the plurality of factors (step S303).

Subsequently, when a frequency interval to be evaluated by using the evaluation index is set by the input of the user of acoustical performance evaluation system 1 (step S4), acoustical performance evaluation device 10 samples the first function data indicating the set reference sound pressure and the second function data indicating the acquired target sound pressure (step S5).

Subsequently, acoustical performance evaluation device 10 performs a deviation calculation process of calculating the evaluation index value (step S6). More specifically, for example, as illustrated in FIG. 8A, acoustical performance evaluation device 10 initially selects the evaluation index by the input of the user of acoustical performance evaluation system 1 (step S601). When the deviation in the differential pressure magnification dB notation is selected as the evaluation index in step S601 (differential pressure magnification dB notation in step S601), acoustical performance evaluation device 10 calculates a differential pressure magnification (referred to as a differential pressure magnification dB) of the sound pressure which is the ratio between the first function data indicating the reference sound pressure and the second function data indicating the target sound pressure (step S602). Subsequently, acoustical performance evaluation device 10 acquires an absolute value of the calculated differential pressure magnification dB (step S603). Thereafter, acoustical performance evaluation device 10 converts a frequency axis notation of the calculated differential pressure magnification dB on a horizontal axis into an Oct axis notation (S604). Acoustical performance evaluation device 10 integrates the converted value in an Oct interval corresponding to the frequency interval set in step S4 (step S605). Acoustical performance evaluation device 10 divides the integrated value by a length when the set frequency interval is represented in the Oct notation (step S606). In this manner, acoustical performance evaluation device 10 can calculate the deviation in the differential pressure magnification dB notation expressed by (Expression 1), that is, the evaluation index.

Meanwhile, when the deviation in differential pressure magnification square dB is selected as the evaluation index in step S601 (differential pressure magnification square dB notation in step S601), acoustical performance evaluation device 10 calculates a differential pressure magnification (referred to as a differential pressure magnification dB) of the sound pressure which is the ratio between the first function data indicating the reference sound pressure and the second function data indicating the target sound pressure (step S607). Subsequently, acoustical performance evaluation device 10 squares the calculated differential pressure magnification dB (step S608). Subsequently, although acoustical performance evaluation device 10 performs the processes of step S604 to step S606, the processes of step S604 to step S606 are as described above, and the description is omitted. In this manner, acoustical performance evaluation device 10 can calculate the deviation in the differential pressure magnification square dB notation expressed by (Expression 2), that is, the evaluation index.

The process of calculating the deviation in the differential pressure magnification dB notation expressed by (Expression 1) and the deviation in the differential pressure magnification square dB notation expressed by (Expression 2) is not limited to the case illustrated in FIG. 8A, and may be the case illustrated in FIG. 8B. Hereinafter, the case illustrated in FIG. 8B will be described. The processes of step S601 to step S603, step S607, and step S608 in FIG. 8B are as described above, and the description is omitted.

When the deviation in the differential pressure magnification dB notation is selected as the evaluation index in step S601 (differential pressure magnification dB notation in step S601), acoustical performance evaluation device 10 performs the processes of step S602 and step S603. Subsequently, acoustical performance evaluation device 10 multiplies the acquired value by the weight function of 1/f as the predetermined weight function (5604A). Acoustical performance evaluation device 10 integrates the multiplied value in the frequency interval set in step S4 (step S605A), and divides the integrated value by a length when the set frequency interval is represented in a logarithm notation (step S606A). In this manner, acoustical performance evaluation device 10 can calculate the deviation in the differential pressure magnification dB notation expressed by (Expression 1), that is, the evaluation index.

Meanwhile, when the deviation in the differential pressure magnification square dB notation is selected as the evaluation index in step S601 (differential pressure magnification square dB notation in step S601), acoustical performance evaluation device 10 performs the processes of step S607 and step S608. Subsequently, acoustical performance evaluation device 10 performs the processes of step S604A to step S606A. In this manner, acoustical performance evaluation device 10 can calculate the deviation in the differential pressure magnification square dB notation expressed by (Expression 2), that is, the evaluation index.

Subsequently, acoustical performance evaluation device 10 compares the evaluation index value calculated in step S6 with the threshold set in step S2 (step S7), and determines whether or not the target sound pressure is favorable (step S8).

The process of step S2 may be performed before the process of step S7. The processes of step S2, step S7, and step S8 are not performed, and the graphs of the target sound pressure and the reference sound pressure and the differential areas between the target sound pressure and the reference sound pressure may be output to display device 17. Also in this case, the evaluation index value obtained in step S6 can be displayed on a screen of display device 17.

<Method of Deriving Evaluation Index of Acoustical Performance>

Now, a method of deriving (Expression 1) will be described with reference to FIG. 9.

Figure 9:
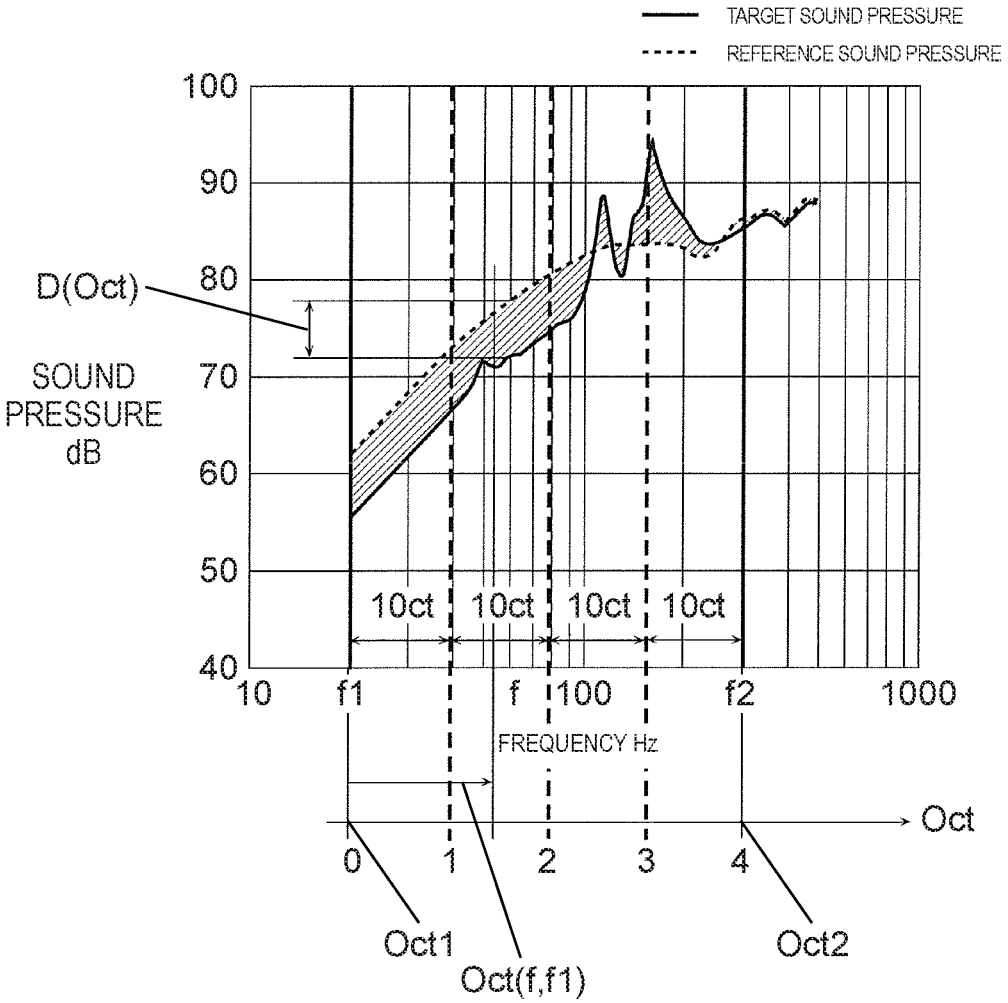
FIG. 9 is a diagram for describing a method of calculating the evaluation index of the acoustical performance of the target sound pressure of the exemplary embodiment.

FIG. 9 is a diagram for describing the method of deriving the evaluation index of the acoustical performance of the target sound pressure of the exemplary embodiment. The target sound pressure and the reference sound pressure illustrated in FIG. 9 are the same as the target sound pressure and the reference sound pressure illustrated in FIG. 4.

Here, when a function in which the reference sound pressure is expressed in the Oct notation is F(Oct) and a function in which the target sound pressure is expressed in the Oct notation is G(Oct), the differential pressure between the reference sound pressure and the target sound pressure in an arbitrary frequency can be expressed by function D(Oct) indicated by the differential pressure magnification expressed by (Expression 3).

$$D(Oct) = \left|20\log_{10}\left(\frac{F(Oct)}{G(Oct)}\right)\right| \quad \text{(Expression 3)}$$

F(Oct) is obtained by converting corresponding frequency f[Hz] into frequency Oct[Oct] in the Oct notation based on the first function data. G(Oct) is similarly obtained based on the second function data.

Hereinafter, a case of a first deriving method of deriving the evaluation index by converting the frequency axis notation on the horizontal axis of FIG. 9 into the Oct axis notation will be described. The first deriving method corresponds to the processes of step S604 to step S606 of FIG. 8A.

<First Deriving Method>

Oct(f, f1) of a position in Oct notation corresponding to an arbitrary frequency f represented on the horizontal axis of FIG. 9 can be expressed by (Expression 4) by using frequency f1 corresponding to an origin and an arbitrary frequency fin the Oct notation.

$$Oct(f, f1) = \log_2\left(\frac{f}{f1}\right) \quad \text{(Expression 4)}$$

Oct2 indicating 4 in the Oct notation represented on the horizontal axis of FIG. 9 can be expressed by (Expression 5)

by using frequency f2 corresponding to 4 in the Oct notation and frequency f1 corresponding to an origin in the Oct notation. Since a sound pressure on a vertical axis is dB, (Expression 5) can be transformed to (Expression 6) from a logarithmic formula.

$$\text{Oct2}=\text{Oct}(f2,f1) \quad \text{(Expression 5)}$$

$$Oct2 = \log_2\left(\frac{f2}{f1}\right) \quad \text{(Expression 6)}$$

Similarly, Oct1 indicating the origin in the Oct notation represented on the horizontal axis of FIG. 9 can be expressed by (Expression 7) by using frequency f1 corresponding to the origin in the Oct notation. (Expression 7) can be transformed to (Expression 8).

$$\text{Oct1}=\text{Oct}(f1,f1) \quad \text{(Expression 7)}$$

$$\text{Oct1}=0 \quad \text{(Expression 8)}$$

The graphs of the target sound pressure and the reference sound pressure represented in FIG. 9 and the differential area between the target sound pressure and the reference sound pressure, that is, differential area S can be obtained by integrating function D(Oct) in an interval between Oct 1 and Oct 2, as expressed by (Expression 9).

$$S = \int_{Oct1}^{Oct2} D(Oct)dOct \quad \text{(Expression 9)}$$

Subsequently, when a value obtained by dividing differential area S by Oct2 which is a length of an interval in the OCT notation is Dp as expressed by (Expression 10), (Expression 9) indicating differential area S is substituted as expressed by (Expression 11).

$$Dp = \frac{S}{Oct2} \quad \text{(Expression 10)}$$

$$Dp = \frac{\int_{Oct1}^{Oct2} D(Oct)dOCT}{Oct2} \quad \text{(Expression 11)}$$

Here, when function Oct is differentiated, (Expression 12) can be obtained.

$$\frac{dOct}{df} = \frac{1}{flog_e(2)} \quad \text{(Expression 12)}$$

Dp can be transformed to the value in the frequency notation by using (Expression 12) in (Expression 11), and (Expression 1) can be derived. In (Expression 1), a function in which the reference sound pressure is expressed in the frequency notation is P2(f), and a function in which the target sound pressure is expressed in the frequency notation is P1(f).

In this manner, (Expression 1) which is an evaluation function for calculating the evaluation index from data represented in FIG. 9 can be derived.

Next, a case of a second deriving method of deriving function D(Oct) by using the frequency axis notation of the horizontal axis of FIG. 9 will be described. The second deriving method corresponds to the processes of step S604A to step S606A of FIG. 8B.

<Second Deriving Method>

Function D(Oct) can be transformed to the frequency notation as represented by (Expression 13) by multiplying function D(Oct) by the weight function of 1/f and using (Expression 4) and (Expression 12).

$$D(Oct)dOct = \frac{D(f)df}{flog_e(2)} \quad \text{(Expression 13)}$$

The graphs of the target sound pressure and the reference sound pressure represented in FIG. 9 and the differential area between the target sound pressure and the reference sound pressure, that is, differential area S can be obtained by integrating function D(f) in the interval between f1 and f2 in the frequency notation as expressed by (Expression 14). Here, the interval between f1 and f2 in the frequency notation is the frequency interval to be evaluated by using the evaluation index by the input of the user of acoustical performance evaluation system 1, and corresponds to the interval between Oct1 and Oct2 described above.

$$S = \int_{f1}^{f2} \frac{D(f)}{flog_e(2)} df \quad \text{(Expression 14)}$$

Subsequently, a value obtained by dividing differential area S by Oct2 which is the length of the interval in the OCT notation is Dp as expressed by (Expression 10). (Expression 6) is substituted, and thus, (Expression 6) can be transformed to an expression obtained by dividing the differential area by the length when the frequency interval between f1 to f2 is expressed in the logarithm notation as expressed by (Expression 15).

$$Dp = \frac{\int_{f1}^{f2} \frac{D(f)}{flog_e(2)} df}{\log_2\left(\frac{f2}{f1}\right)} \quad \text{(Expression 15)}$$

(Expression 15) can also be transformed to (Expression 16) by the logarithm formula.

$$Dp = \frac{\int_{f1}^{f2} \frac{D(f)}{f} df}{\log_e(f2) - \log_e(f1)} \quad \text{(Expression 16)}$$

In this manner, (Expression 1) which is an evaluation function for calculating the evaluation index from data represented in FIG. 9 can be derived. In (Expression 1), a function in which the reference sound pressure is expressed in the frequency notation is P2(f), and a function in which the target sound pressure is expressed in the frequency notation is P1(f).

When a function in which the reference sound pressure is expressed in the Oct notation is F(Oct) and a function in which the target sound pressure is expressed in the Oct notation is G(Oct), the differential pressure between the reference sound pressure and the target sound pressure in an arbitrary frequency can be expressed by function D(Oct) expressed by square of a differential pressure magnification expressed by (Expression 17). A method of deriving (Expression 2) which is the evaluation function for calculating the evaluation index from the data represented in FIG. 9 from (Expression 17) is as described in the first deriving method and the second deriving method, and thus, the description is omitted.

$$D(Oct) = 400\log_{10}\left(\frac{F(Oct)}{G(Oct)}\right)^2 \quad \text{(Expression 17)}$$

[Effects and Others]

According to the acoustical performance evaluation method of the present exemplary embodiment, it is possible to accurately evaluate the acoustical performance of the loudspeaker to be evaluated.

More specifically, in the acoustical performance evaluation method of the present disclosure, the sound pressure in the anechoic chamber with consideration for only the influence of the first factor of the plurality of factors that causes the deterioration in frequency response of sound pressure level of the loudspeaker to be evaluated is quantified as the reference sound pressure, and the total deviation quantity between the reference sound pressure and the target sound pressure is quantified as the evaluation index. Accordingly, since it is possible to quantify acoustical performance of the loudspeaker to be evaluated and it is possible to easily set the threshold, it is possible to easily determine whether or not the performance of the loudspeaker to be evaluated is favorable.

In the acoustical performance evaluation method of the present disclosure, the evaluation index is calculated by using (Expression 1) or (Expression 2). That is, the target sound pressure and the reference sound pressure is calculated by the physical quantities in the pressure dimension, and the differential pressure is calculated by dB conversion (or the differential deviation quantity of the square of the differential pressure is calculated by $dB^2$ conversion). An average value is calculated by multiplying the ratio between the first function data and the second function data by the weight function of 1/f in the predetermined frequency interval indicated by the range from f1 to f2 to be evaluated, integrating the multiplied value, and dividing the integrated value by the horizontal axis length ($\log_e f2 - \log_e f1$) of the octave scale using f1 as the base.

As stated above, in the acoustical performance evaluation method of the present disclosure, a mathematically defined clear integral formula is used as the method of defining the evaluation index. Thus, it is possible to calculate the evaluation index irrespective of whether frequency response data of sound pressure level indicating the target sound pressure and the reference sound pressure is discretized data or data indicated by a continuous function and irrespective of an equal interval or unequal interval of the discretized data. In the acoustical performance evaluation method of the present disclosure, since an integration using a high-order approximation function can be performed, it is possible to reduce an error caused by data discretization. In the acoustical performance evaluation method of the present disclosure, the average value of the octave scale is obtained, and thus, it is possible to compare the deviation quantity, that is, the evaluation index between even data items of which the lengths in the frequency domain as the intervals to be evaluated, that is, the positions are different.

Examples of the acoustical performance evaluation using the acoustical performance evaluation method described above are illustrated in FIGS. 13A to 13D and 14.

FIGS. 13A to 13D are diagrams illustrating examples of a measurement system for acquiring the frequency response of sound pressure level of the target sound pressure through the measurement experiment in acoustical performance evaluation system 1.

Figure 13A:
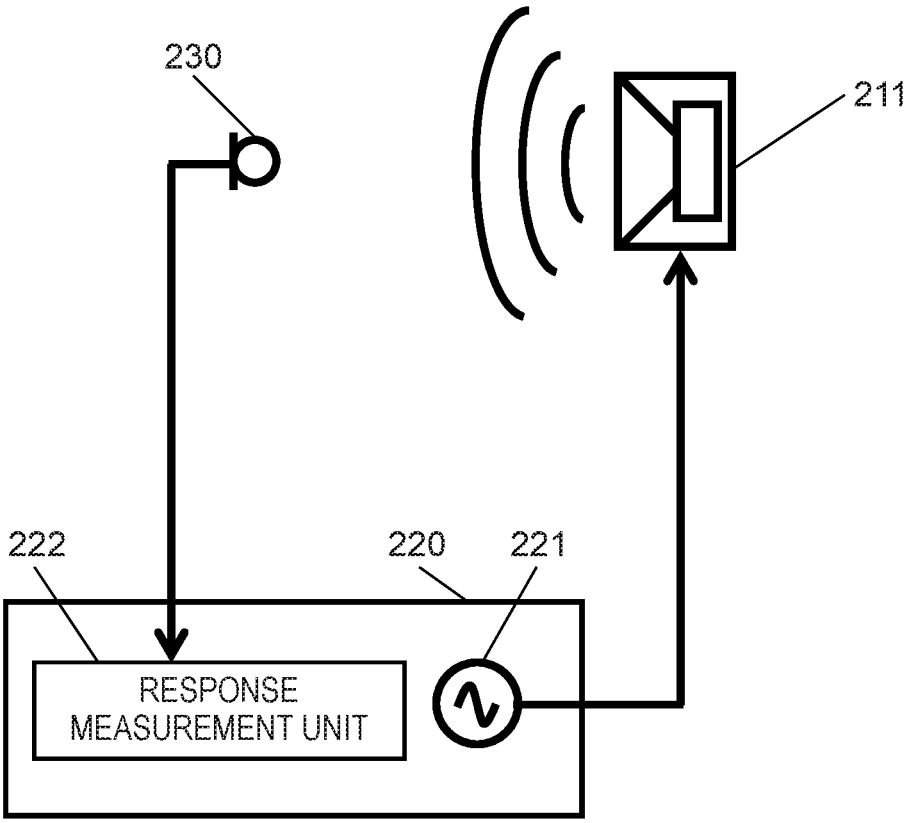
FIG. 13A is a diagram illustrating an example of a measurement system for evaluating the acoustical performance.

FIG. 13A illustrates a schematic diagram of a measurement system when the acoustical performance of loudspeaker 211 are measured. The acoustical performance of loudspeaker 211 measured herein are frequency response of sound pressure level not including the first factor.

Sound pressure frequency performance measurement system 220 includes signal source 221 and response measurement unit 222.

Signal source 221 outputs an evaluation sound source signal for driving loudspeaker 211. Signal source 221 causes loudspeaker 211 to output, as the evaluation sound source signal, a signal having a plurality of frequencies including a lower limit and an upper limit of a frequency range to be measured. Specifically, when lower limit frequency f1 is 20 Hz and upper limit frequency f2 is 500 Hz, signal source 221 causes loudspeaker 211 to output sound of a frequency being changed from 20 Hz to 500 Hz. The evaluation sound source signal may be an analog electrical signal output by an amplifier of signal source 221, or may be a digital signal for controlling loudspeaker 211.

Sound collection device 230 is, for example, a device such as a microphone for sensing a sound pressure. Sound collection device 230 senses the sound pressure of the sound output from loudspeaker 211. Sound collection device 230 outputs a response signal depending on the sensed sound pressure to sound pressure frequency performance measurement system 220. The response signal may be an analog electrical signal corresponding to the sensed sound pressure, or may be a digital signal discretized by sound collection device 230. The response signal may be a change in electrical performance such as impedance of sound collection device 230.

Response measurement unit 222 of sound pressure frequency performance measurement system 220 analyzes the response signal output from sound collection device 230, and estimates the frequency response of sound pressure level of loudspeaker 211 to be measured.

Response measurement unit 222 specifies a time waveform of the sound pressure sensed by sound collection device 230 based on the response signal. Response measurement unit 222 acquires frequencies and amplitudes in some time intervals based on the specified time waveform. Accordingly, it is possible to estimate the frequency response of sound pressure level corresponding to each frequency. As long as the amplitude at each frequency can be estimated, the method of acquiring the frequencies and amplitudes is not limited to the aforementioned method.

The frequency response of sound pressure level of the present exemplary embodiment are not limited to the sound pressure sensed by sound collection device 230. For example, when the evaluation sound source signal output by signal source 221 has frequency dependence and nonlinearity, response measurement unit 222 may correct the influence of the frequency dependence and nonlinearity. Similarly, response measurement unit 222 may correct the frequency dependence or nonlinearity of sound collection device 230.

In the example illustrated in FIG. 13A, when the acoustical performance of loudspeaker 211 are measured, the influence of the object (housing) to which loudspeaker 211 is attached is not considered. However, when the acoustical performance of loudspeaker 211 are actually measured, loudspeaker 211 is not preferably fixed to the object. FIG. 13D illustrates a case where the object is ideal housing 219. Ideal housing 219 is, for example, a JIS box decided by Japanese Industrial Standards (JIS).

In FIG. 13D, evaluated target 210 includes ideal housing 219, and loudspeaker 211 attached to ideal housing 219. Sound pressure frequency performance measurement system 220 measures the frequency response of sound pressure level of evaluated target 210, as in the example of FIG. 13A. Accordingly, it is possible to estimate the acoustical performance (frequency response of sound pressure level) when loudspeaker 211 is attached to ideal housing 219.

As mentioned above, the frequency response of sound pressure level of the reference sound pressure are set by using the measurement experiment in step S103 of FIG. 6. For example, the frequency response of sound pressure level acquired in a configuration of FIG. 13D may be regarded as frequency response of sound pressure level not including the first factor, and may be set as the reference sound pressure.

Figure 13B:
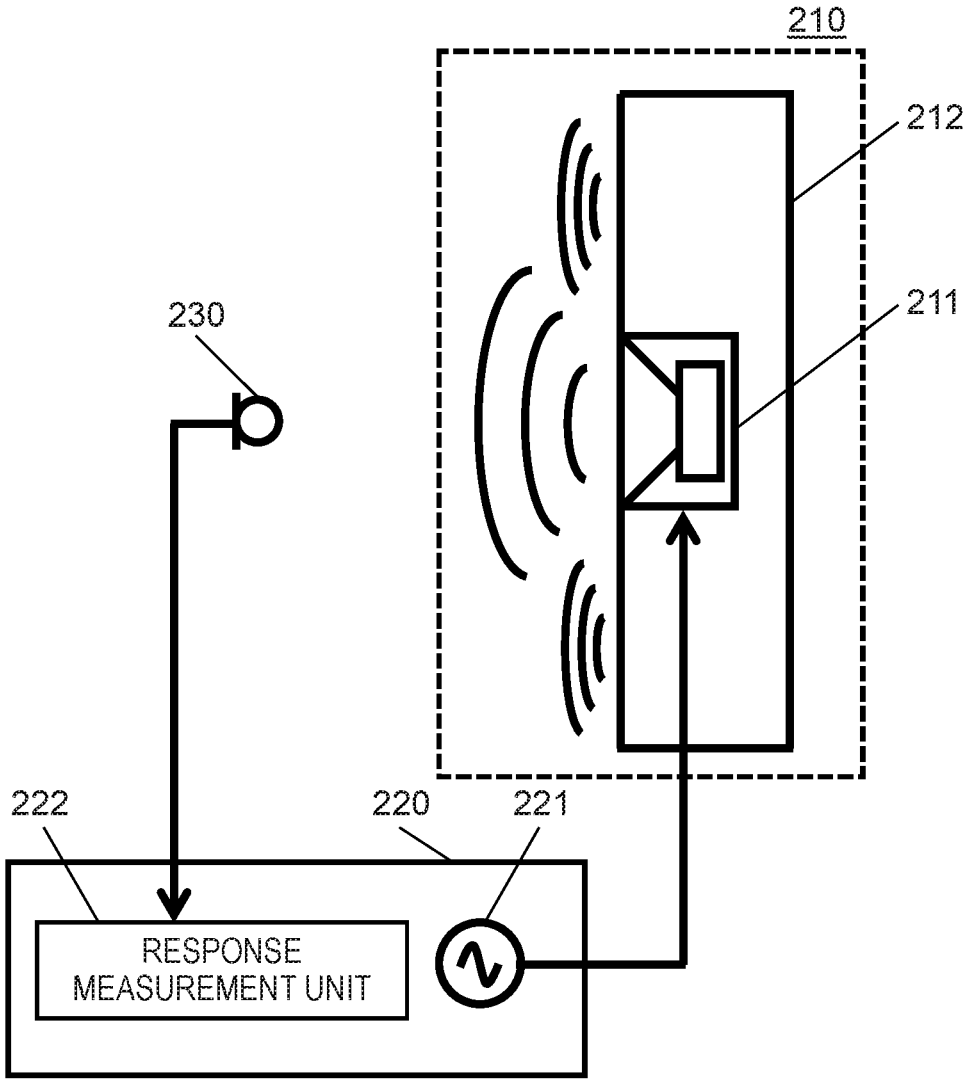
FIG. 13B is a diagram illustrating an example of the measurement system for evaluating the acoustical performance.
Figure 13C:
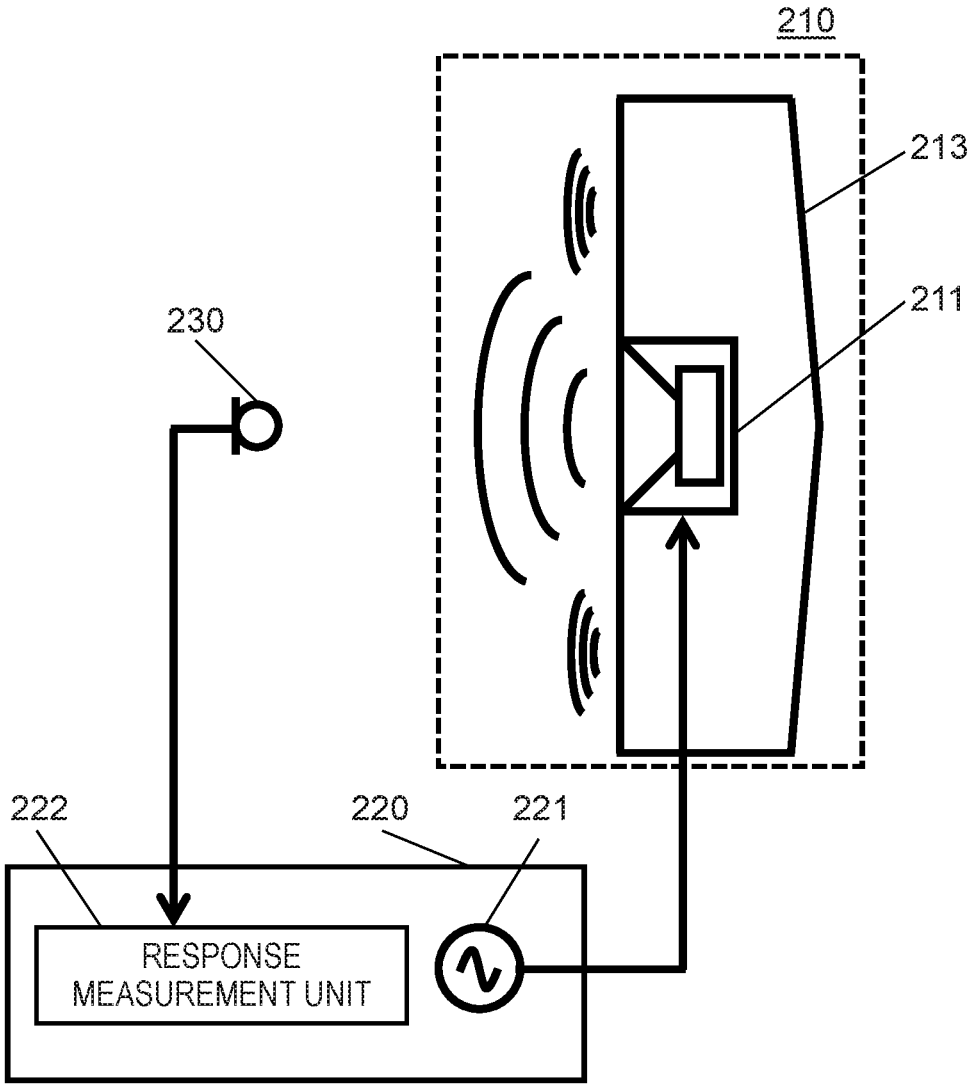
FIG. 13C is a diagram illustrating an example of the measurement system for evaluating the acoustical performance.
Figure 13D:
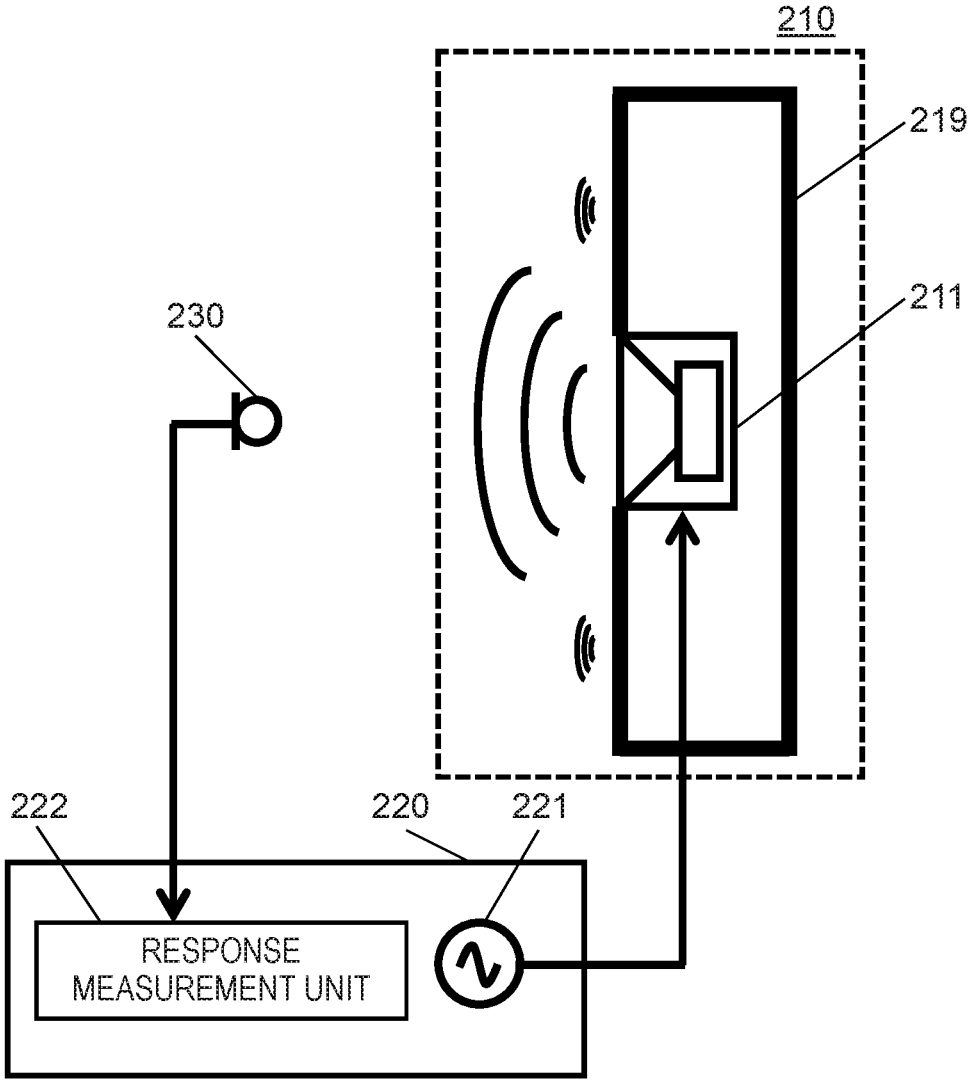
FIG. 13D is a diagram illustrating an example of the measurement system for evaluating the acoustical performance.

FIGS. 13B and 13C illustrate configurations of a case where loudspeaker 211 is attached to housing 212 and housing 213 which are different objects. housing 212 and housing 213 may have the same external shape. For example, these housings may have internal structures and materials different from each other. The frequency response of sound pressure level when loudspeaker 211 is attached to housing 212 can be measured in the configuration of FIG. 13B. Similarly, the frequency response of sound pressure level when loudspeaker 211 is attached to housing 213 can be measured in the configuration of FIG. 13C.

For example, when the frequency response of sound pressure level of the target sound pressure are acquired through the measurement as described in step S302 of FIG. 7, the frequency response of sound pressure level acquired in the configuration of FIG. 13B can be regarded as the frequency response of sound pressure level when the first factor is housing 212, and can be set as the frequency response of sound pressure level of the target sound pressure. The frequency response of sound pressure level when the first factor is housing 213 can be similarly acquired by using the configuration of FIG. 13C.

It is possible to calculate the evaluation indices (dB/Oct and $dB^2$/Oct) of these configurations based on the frequency response of sound pressure level of different objects (housing 212 and housing 213) acquired as stated above and the frequency response of sound pressure level when the object is ideal housing 219. Accordingly, it is possible to easily determine which configuration of housing 212 and housing 213 approaches the frequency response of sound pressure level of ideal housing 219, that is, the acoustical performance are favorable based on the calculated evaluation indices.

It has been described that the frequency response of sound pressure level of the reference sound pressure and the target sound pressure are acquired through the measurement. However, when the object corresponding to housing 212 or housing 213 cannot be prepared, or when the housing is being designed, it is not possible to estimate the frequency response of sound pressure level with consideration for the influence of the first factor through the measurement.

According to acoustical performance evaluation system 1 of the present exemplary embodiment, the frequency response of sound pressure level including the influence of the first factor when loudspeaker 211 is attached the object (housing 212 or housing 213) can be evaluated through any of the measurement and the simulation or a combination of the measurement and the simulation. Accordingly, it is possible to estimate the comparison of the acoustical performance of a plurality of objects (housing 212 and housing 213) having different configurations without depending on only the measurement.

FIG. 14 illustrates an example of a case where acoustical performance of a plurality of different objects (housing 212 and housing 213) are compared. Here, the frequency response of sound pressure level when loudspeaker 211 is attached to ideal housing 219 are used as the reference sound pressure. It can be seen from FIG. 14 that dB/Oct and $dB^2$/Oct which are the evaluation indices when loudspeaker 211 is attached to housing 213 are smaller than dB/Oct and $dB^2$/Oct when loudspeaker 211 is attached to housing 212. That is, it is possible to estimate that the acoustical performance estimated from the evaluation index in housing 213 are more favorable than the acoustical performance in housing 212.

As stated above, it is possible to compare the acoustical performance for the plurality of configurations of which the first factors are different by using the evaluation indices for which only the influences of housing 212 and housing 213 which are the first factors are considered.

Modification Example

Although it has been described that the target sound pressure and the reference sound pressure are measured through the measurement experiment, the evaluation indices may be calculated by using only the target sound pressure and the reference sound pressure calculated through the simulation. In this case, it is possible to calculate, as the target sound pressure, a plurality of target sound pressures with consideration for two factors, three factors, and four factors including the first factor of the plurality of factors. Accordingly, it can be seen that which factor of the plurality of factors is effective as a target of the countermeasure for enhancing the frequency response of sound pressure level in order for the target sound pressure to approach the reference sound pressure.

Hereinafter, examples of the evaluation indices of the target sound pressure and the reference sound pressure calculated through the simulation when the loudspeaker to be evaluated is embedded in the side door of the vehicle will be described.

Figure 10:
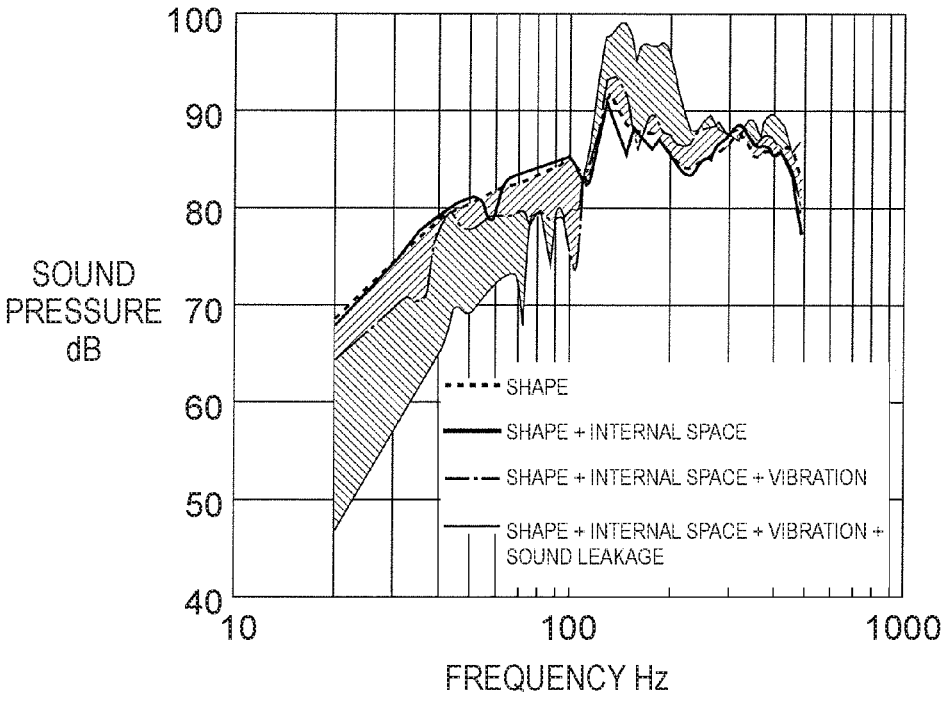
FIG. 10 is a diagram illustrating another example of the evaluation index of the acoustical performance of the target sound pressure of the exemplary embodiment.

FIG. 10 is a diagram illustrating an example of the evaluation index of the acoustical performance of the target sound pressure of the modification example.

When the loudspeaker to be evaluated is embedded in the side door of the vehicle, the plurality of factors is a shape of the door of the vehicle, an internal space of the door of the vehicle, a vibration of the door of the vehicle, and a sound leakage from the door of the vehicle, as described above.

The reference sound pressure of the present modification example is a graph of "shape" represented by a dotted line in FIG. 10. The first factor for which the countermeasure for enhancing the frequency response of sound pressure level of the loudspeaker is not prep arable is the shape of the door of the vehicle as stated above. Thus, the graph of "shape" is the frequency response of sound pressure level calculated through the simulation with consideration for only the influence of the shape of the door of the vehicle.

The target sound pressure of the present modification example corresponds to any of a graph of "shape+internal space" represented by a thick solid line, a graph of "shape+ internal space+vibration" represented by a dashed dotted line, and a graph of "shape+internal space+vibration+sound leakage" represented by a fine solid line in FIG. 10. That is, the target sound pressure of the present modification example is frequency response of sound pressure level calculated with consideration for only the influences of the factor of the shape and the factor of the internal space including the factor of the shape which is the first factor of the plurality of factors. Alternatively, the target sound pressure of the present modification example is frequency response of sound pressure level calculated with consideration for only the influences of the factor of the shape, the factor of the internal space, and the factor of the vibration including the factor of the shape which is the first factor. Alternatively, the target sound pressure of the present modification example is frequency response of sound pressure level calculated with consideration for only the influences of the factor of the shape, the factor of the internal space, the factor of the vibration, the factor of the sound leakage including the factor of the shape which is the first factor.

Figure 11:
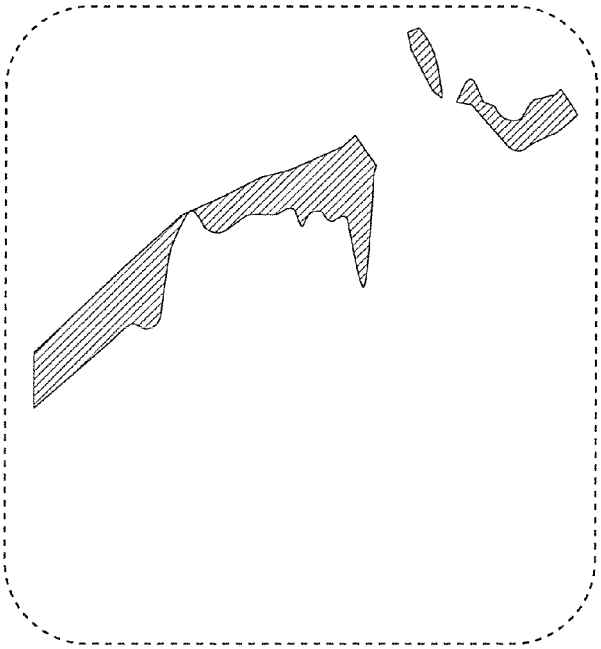
FIG. 11 is a diagram illustrating a differential area corresponding to an evaluation index without a sound leakage in FIG. 10.
Figure 12:
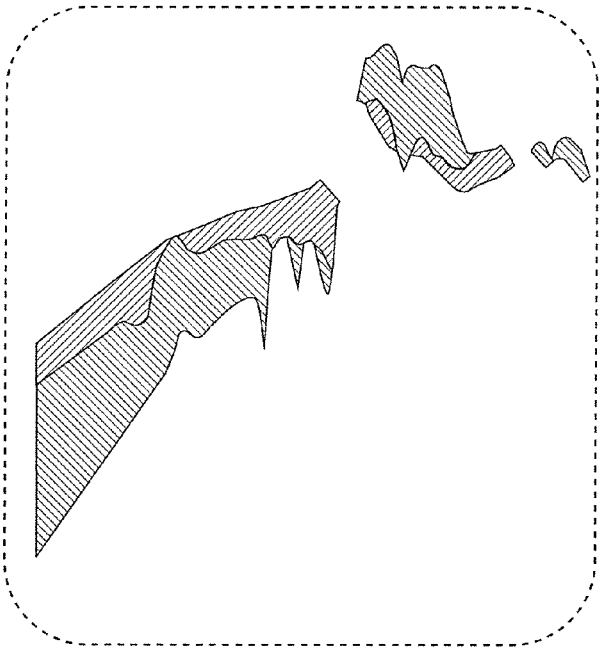
FIG. 12 is a diagram illustrating a differential area corresponding to a total evaluation index in FIG. 10.

FIG. 11 is a diagram illustrating a differential area corresponding to an evaluation index without the sound leakage in FIG. 10. FIG. 12 is a diagram illustrating a differential area corresponding to a total evaluation index illustrated in FIG. 10.

In FIG. 11, the differential area corresponding to the evaluation index when the target sound pressure is the frequency response of sound pressure level calculated with consideration for only the influences of three factors of the factor of the shape, the factor of the internal space, and the factor of the vibration is illustrated. In FIG. 12, the differential area corresponding to the evaluation index when the target sound pressure is the frequency response of sound pressure level calculated with consideration for only the influence of four factors of the factor of the shape, the factor of the internal space, the factor of the vibration, and the factor of the sound leakage is illustrated.

As can be seen from the comparison of FIGS. 11 and 12, the differential area between the target sound pressure without the influence of the factor of the sound leakage and the reference sound pressure is drastically smaller than the differential area between the target sound pressure with the influence of the factor of the sound leakage and the reference sound pressure. That is, it can be seen that it is effective to prepare the countermeasure against the sound leakage in order to improve the acoustical performance of the loudspeaker to be evaluated illustrated in FIG. 10.

As stated above, it is possible to easily prepare an effective countermeasure for improving the acoustical performance by calculating the target sound pressure for each combination of the plurality of factors.

As described above, according to the present modification example, since the evaluation indices can be calculated by removing an arbitrary factor of the plurality of factors and calculating the target sound pressure with consideration for the influence of two or more factors including the first factor, it is possible to obtain an effect of easily preparing the effective countermeasure for improving the acoustical performance.

Although it has been described in the exemplary embodiment that (Expression 1) or (Expression 2) is used as the expression for calculating the evaluation index, the present disclosure is not limited thereto. For example, an expression such as (Expression 18) may be used.

$$dB^n/Oct = \frac{1}{\log_e(f2)-\log_e(f1)}\int_{f1}^{f2}\frac{|20\log_{10}(P_1(f)/P_2(f))|^n}{f}df \quad \text{(Expression 18)}$$

Here, n is an arbitrary real number of 1 or more. (Expression 1) corresponds to a case where n is 1, and (Expression 2) corresponds a case where n is 2. n is set to be a larger value, and thus, when the target sound pressure and the reference sound pressure are greatly separated from each other, the evaluation index value is evaluated to become large, that is, the acoustical performance are evaluated to be low. Accordingly, since it is possible to increase the evaluation index value of the target sound pressure of which the frequency response of sound pressure level greatly deteriorate locally, it is possible to increase a correlation between actual acoustical performance and evaluation index value.

A right side of (Expression 2) or (Expression 18) may be an n-th root of a right side. In this case, it is possible to obtain an evaluation index normalized to a reference of (Expression 1). Specifically, when an absolute value of the difference in frequency response of sound pressure level between the reference sound pressure and the target sound pressure is constant in the entire frequency range to be evaluated, the evaluation indices can also have the same value. Accordingly, it is possible to easily prepare the comparison between the evaluation indices. Since dB and Oct are dimensionless quantities and do not have physical dimensions, $dB^n$/Oct which is the evaluation index in this case may have any unit system as in (Expression 1) and (Expression 2). For example, when the acoustical performance are evaluated by an expression obtained by further multiplying a right side of (Expression 18) by a constant term, the evaluation index has a unit of the constant term, and when the evaluation index has the dimensionless quantity as it is, the evaluation index may not have a unit, and the references may be unified.

Feasibility of Other Embodiments

The present disclosure is not limited to the aforementioned exemplary embodiment. For example, any combination of the components described in the present specification and other exemplary embodiments achieved by removing some components may be included in the exemplary embodiment of the present disclosure. The present disclosure also includes modification examples obtained by implementing various modifications obtained by variously changing the exemplary embodiment by those skilled in the art without departing from the gist of the present disclosure, that is, the meanings of the wording in the claims.

INDUSTRIAL APPLICABILITY

The present disclosure is applicable to an acoustical performance evaluation method of evaluating acoustical performance when a loudspeaker is stored in a housing. In particular, the present disclosure is applicable to an acoustical performance evaluation method of evaluating acoustical performance when a loudspeaker is stored in a non-box-shaped housing such as a television, a mobile terminal, and a door of a vehicle.

What is claimed is:

1. An acoustical performance evaluation method comprising:

deciding a reference sound pressure, the reference sound pressure being a frequency response of a sound pressure level of a loudspeaker in an anechoic chamber calculated through a simulation or measured through a measurement experiment, the reference sound pressure being decided by considering only an influence of a first factor of a plurality of factors causing a deterioration in the frequency response of the sound pressure level of the loudspeaker; and calculating a deviation between the reference sound pressure and a target sound pressure, the target sound pressure being the frequency response of the sound pressure level of the loudspeaker in the anechoic chamber calculated through the simulation or measured through the measurement experiment, the calculated deviation being an evaluation of acoustical performance.

2. The acoustical performance evaluation method according to claim 1, wherein the target sound pressure is calculated through the simulation or is measured through the measurement experiment with consideration for two or more factors including the first factor of the plurality of factors.

3. The acoustical performance evaluation method according to claim 1, wherein the deviation is calculated by integrating a value obtained by multiplying a ratio between first function data indicating the reference sound pressure and second function data indicating the target sound pressure by a predetermined weight function in a frequency axis direction.

4. The acoustical performance evaluation method according to claim 3, wherein the deviation is calculated according to Expression 1, $$\mathrm{dB}/Oct = \frac{1}{\log_e(f2)-\log_e(f1)}\int_{f1}^{f2}\frac{|20\log_{10}(P_1(f)/P_2(f))|^n}{f}df \quad \text{(Expression 1)}$$

where dB/Oct is the deviation, f1 is a lower limit frequency, f2 is an upper limit frequency, P1(f) is a first function of the first function data, and P2(f) is a second function of the second function data.

5. The acoustical performance evaluation method according to claim 3, wherein the deviation is calculated according to Expression 2, $$\mathrm{dB}^2/Oct = \frac{1}{\log_e(f2)-\log_e(f1)}\int_{f1}^{f2}\frac{|20\log_{10}(P_1(f)/P_2(f))|^n}{f}df \quad \text{(Expression 2)}$$

where dB2/Oct is the deviation, f1 is a lower limit frequency, f2 is an upper limit frequency, P1(f) is a first function of the first function data, and P2(f) is a second function of the second function data.

6. The acoustical performance evaluation method according to claim 1, wherein the deviation is a differential area integral average of a graph represented by first function data indicating the reference sound pressure using a frequency as an argument and a sound pressure as a return value and a graph represented by second function data indicating the target sound pressure using the frequency as the argument and the sound pressure as the return value.

7. The acoustical performance evaluation method according to claim 6, wherein, in the deviation calculation step, the deviation is calculated according to Expression 1, $$\mathrm{dB}/Oct = \frac{1}{\log_e(f2)-\log_e(f1)}\int_{f1}^{f2}\frac{|20\log_{10}(P_1(f)/P_2(f))|^n}{f}df \quad \text{(Expression 1)}$$

where dB/Oct is the deviation, f1 is a lower limit frequency, f2 is an upper limit frequency, P1(f) is a first function of the first function data, and P2(f) is a second function of the second function data.

8. The acoustical performance evaluation method according to claim 6, wherein the deviation is calculated according to Expression 2, $$\mathrm{dB}^2/Oct = \frac{1}{\log_e(f2)-\log_e(f1)}\int_{f1}^{f2}\frac{|20\log_{10}(P_1(f)/P_2(f))|^n}{f}df \quad \text{(Expression 2)}$$

where dB2/Oct is the deviation, f1 is a lower limit frequency, f2 is an upper limit frequency, P1(f) is a first function of the first function data, and P2(f) is a second function of the second function data.

9. The acoustical performance evaluation method according to claim 1, wherein the deviation is a standard deviation between first function data indicating the reference sound pressure using a frequency as an argument and a sound pressure as a return value and second function data indicating the target sound pressure using the frequency as the argument and the sound pressure as the return value.

10. The acoustical performance evaluation method according to claim 1, wherein the first factor is a factor that a countermeasure for enhancing the frequency response of sound pressure level is not taken for the loudspeaker.

11. The acoustical performance evaluation method according to claim 10, wherein the first factor is a shape of an object into which the loudspeaker is attached.

12. The acoustical performance evaluation method according to claim 11, wherein the plurality of factors includes a shape of the object, an internal space of the object, a vibration of the object, and a sound leakage from the object.

13. The acoustical performance evaluation method according to claim 10, wherein, when the loudspeaker is embedded in a door of a vehicle, the first factor is a shape of the door.

14. The acoustical performance evaluation method according to claim 10, wherein, when the loudspeaker is embedded in a door of a vehicle, the plurality of factors includes a shape of the door, an internal space of the door, a vibration of the door, and a sound leakage from the door.

* * * * *